US009881592B2

(12) United States Patent
Ryu et al.

(10) Patent No.: US 9,881,592 B2
(45) Date of Patent: Jan. 30, 2018

(54) HARDWARE OVERLAY ASSIGNMENT

(71) Applicant: Nvidia Corporation, Santa Clara, CA (US)

(72) Inventors: Donghan Ryu, Seoul (KR); Naoya Yamoto, Tokyo (JP)

(73) Assignee: NVIDIA CORPORATION, Santa Clara, CA (US)

( * ) Notice: Subject to any disclaimer, the term of this patent is extended or adjusted under 35 U.S.C. 154(b) by 199 days.

(21) Appl. No.: 14/048,882

(22) Filed: Oct. 8, 2013

(65) Prior Publication Data

US 2015/0100884 A1 Apr. 9, 2015

(51) Int. Cl.

| | |
|---|---|
| ***G09G 5/00*** | (2006.01) |
| ***G09G 5/397*** | (2006.01) |
| ***G09G 5/14*** | (2006.01) |
| ***G09G 5/393*** | (2006.01) |

(52) U.S. Cl.

CPC ..... *G09G 5/397* (2013.01); *G09G 5/14* (2013.01); *G09G 5/393* (2013.01); *G09G 2340/12* (2013.01)

(58) Field of Classification Search

CPC ..... G09G 2340/10; G09G 5/026; G09G 2310/04; G06F 2203/04804; G06F 3/048; H04N 9/76; G06T 15/503; G06T 2210/62

See application file for complete search history.

(56) References Cited

U.S. PATENT DOCUMENTS

| | | | | |
|---|---|---|---|---|
| 5,124,804 | A | 6/1992 | Socarras | |
| 5,440,705 | A | 8/1995 | Wang et al. | |
| 5,638,501 | A * | 6/1997 | Gough | G06F 3/0481 345/639 |
| 5,646,675 | A | 7/1997 | Copriviza et al. | |
| 5,995,081 | A | 11/1999 | Kato | |
| 6,188,442 | B1 | 2/2001 | Narayanaswami | |
| 6,266,736 | B1 | 7/2001 | Atkinson et al. | |
| 6,684,305 | B1 | 1/2004 | Deneau | |
| 6,952,825 | B1 | 10/2005 | Cockx et al. | |
| 7,119,803 | B2 | 10/2006 | Stanley et al. | |
| 7,337,300 | B2 | 2/2008 | Fronte et al. | |
| 7,441,233 | B1 | 10/2008 | Orndorff et al. | |
| 8,276,132 | B1 | 9/2012 | Vanderspek et al. | |
| 8,539,164 | B2 | 9/2012 | Warner et al. | |
| 8,400,605 | B2 | 3/2013 | Lee | |
| 8,525,799 | B1 | 9/2013 | Grivna et al. | |
| 8,531,471 | B2 | 9/2013 | Chen et al. | |
| 8,542,208 | B2 | 9/2013 | Krah et al. | |
| 8,773,386 | B2 | 7/2014 | Wilson et al. | |
| 8,816,985 | B1 | 8/2014 | Tate et al. | |

(Continued)

*Primary Examiner* — Hau Nguyen

(57) ABSTRACT

An aspect of the present invention proposes a novel approach that can reduce the total number of the overlays to be composited during the display of graphical output in a mobile computing device. As a result, the total number of memory bandwidth and the usage of a graphics processing unit by a pre-compositor can be decreased significantly. According to one embodiment, this new approach is implemented with a display panel with embedded memory which supports a partial update, or refresh feature. Which such a feature, the layer compositor (typically either the display controller or GPU) is able to keep track of actively updating regions of a display panel by checking if each layer has new content to be displayed.

20 Claims, 6 Drawing Sheets

500

(56) References Cited

U.S. PATENT DOCUMENTS

| | | | |
|---|---|---|---|
| 8,963,881 | B2 | 2/2015 | Huang et al. |
| 8,970,506 | B2 | 3/2015 | Krah et al. |
| 9,342,181 | B2 | 5/2016 | Wyatt et al. |
| 9,405,561 | B2 | 8/2016 | Giroux |
| 2002/0063671 | A1 | 5/2002 | Knapp |
| 2002/0085118 | A1 | 7/2002 | Harris et al. |
| 2002/0167542 | A1 | 11/2002 | Florin |
| 2004/0133923 | A1 | 7/2004 | Watson et al. |
| 2004/0207630 | A1 | 10/2004 | Moreton et al. |
| 2005/0012723 | A1 | 1/2005 | Pallakoff |
| 2005/0080998 | A1 | 4/2005 | Day et al. |
| 2005/0171879 | A1 | 8/2005 | Lin |
| 2005/0254702 | A1 | 11/2005 | Era |
| 2007/0268200 | A1 | 11/2007 | Fuller et al. |
| 2008/0036743 | A1 | 2/2008 | Westerman et al. |
| 2008/0082930 | A1 | 4/2008 | Omernick et al. |
| 2008/0137159 | A1 | 6/2008 | Lim |
| 2008/0162996 | A1 | 7/2008 | Krah et al. |
| 2008/0162997 | A1 | 7/2008 | Vu et al. |
| 2008/0165141 | A1 | 7/2008 | Christie |
| 2008/0278467 | A1 | 11/2008 | Hwang et al. |
| 2008/0284745 | A1 | 11/2008 | Kao et al. |
| 2009/0055596 | A1 | 2/2009 | Wallach et al. |
| 2009/0167727 | A1 | 7/2009 | Liu et al. |
| 2009/0224776 | A1 | 9/2009 | Keith |
| 2009/0256814 | A1 | 10/2009 | Chung et al. |
| 2009/0262637 | A1 | 10/2009 | Badaye et al. |
| 2009/0295786 | A1 | 12/2009 | Ito et al. |
| 2010/0007582 | A1 | 1/2010 | Zalewski |
| 2010/0020092 | A1 | 1/2010 | Canu et al. |
| 2010/0079508 | A1 | 4/2010 | Hodge et al. |
| 2010/0097343 | A1 | 4/2010 | Fang |
| 2010/0128201 | A1 | 5/2010 | Lee |
| 2010/0134437 | A1 | 6/2010 | Yang et al. |
| 2010/0171753 | A1 | 7/2010 | Kwon |
| 2010/0235732 | A1 | 9/2010 | Bergman |
| 2010/0238130 | A1 | 9/2010 | Lin et al. |
| 2010/0253639 | A1 | 10/2010 | Huang et al. |
| 2010/0277463 | A1 | 11/2010 | Yen et al. |
| 2010/0309985 | A1 | 12/2010 | Liu et al. |
| 2011/0012940 | A1 | 1/2011 | Lim |
| 2011/0043546 | A1 | 2/2011 | Matsumoto |
| 2011/0078358 | A1 | 3/2011 | Shebanow |
| 2011/0122088 | A1 | 5/2011 | Lin et al. |
| 2011/0127340 | A1 | 6/2011 | Aiken |
| 2011/0157334 | A1 | 6/2011 | Kim et al. |
| 2011/0161707 | A1 | 6/2011 | Blackburn et al. |
| 2011/0181519 | A1 | 7/2011 | Tsai et al. |
| 2011/0242120 | A1 | 10/2011 | Akai et al. |
| 2011/0261026 | A1 | 10/2011 | Kim et al. |
| 2011/0273376 | A1 | 11/2011 | Dickinson et al. |
| 2012/0026157 | A1 | 2/2012 | Unkel et al. |
| 2012/0030623 | A1 | 2/2012 | Hoellwarth |
| 2012/0050206 | A1 | 3/2012 | Welland |
| 2012/0054379 | A1 | 3/2012 | Leung et al. |
| 2012/0068964 | A1 | 3/2012 | Wright et al. |
| 2012/0084798 | A1 | 4/2012 | Reeves et al. |
| 2012/0105357 | A1 | 5/2012 | Li et al. |
| 2012/0105362 | A1 | 5/2012 | Kremin et al. |
| 2012/0139918 | A1* | 6/2012 | Michail ..... G06T 15/503 345/421 |
| 2012/0146957 | A1 | 6/2012 | Dunagan |
| 2012/0154324 | A1 | 6/2012 | Wright et al. |
| 2012/0176327 | A1 | 7/2012 | Na et al. |
| 2012/0176546 | A1 | 7/2012 | Yoon |
| 2012/0223894 | A1 | 9/2012 | Zhao et al. |
| 2012/0254497 | A1 | 10/2012 | Ni et al. |
| 2012/0262463 | A1 | 10/2012 | Bakalash et al. |
| 2012/0327041 | A1 | 12/2012 | Harley et al. |
| 2013/0038587 | A1 | 2/2013 | Song et al. |
| 2013/0044078 | A1 | 2/2013 | Hallenberg et al. |
| 2013/0061240 | A1 | 3/2013 | Yan et al. |
| 2013/0069894 | A1 | 3/2013 | Chen et al. |
| 2013/0088479 | A1 | 4/2013 | Kim et al. |
| 2013/0100071 | A1 | 4/2013 | Wright et al. |
| 2013/0128120 | A1* | 5/2013 | Chanda ..... H04N 5/44504 348/600 |
| 2013/0135191 | A1 | 5/2013 | Shiokawa |
| 2013/0141423 | A1 | 6/2013 | Cho et al. |
| 2013/0173894 | A1 | 7/2013 | Yan et al. |
| 2013/0194242 | A1 | 8/2013 | Park et al. |
| 2013/0222323 | A1 | 8/2013 | McKenzie |
| 2013/0249823 | A1 | 9/2013 | Ahn et al. |
| 2013/0265276 | A1 | 10/2013 | Obeidat et al. |
| 2013/0285933 | A1 | 10/2013 | Sim et al. |
| 2014/0028633 | A1 | 1/2014 | Mercea et al. |
| 2014/0085437 | A1 | 3/2014 | Unkel et al. |
| 2014/0092031 | A1 | 4/2014 | Schwartz et al. |
| 2014/0118257 | A1 | 5/2014 | Baldwin |
| 2014/0149754 | A1 | 5/2014 | Silva et al. |
| 2014/0204036 | A1 | 7/2014 | Schillings et al. |
| 2014/0267192 | A1 | 9/2014 | Matsuura et al. |
| 2014/0340387 | A1 | 11/2014 | Song et al. |
| 2014/0362109 | A1 | 12/2014 | Han et al. |
| 2015/0015497 | A1 | 1/2015 | Leigh |
| 2015/0015528 | A1 | 1/2015 | Vandermeijden |
| 2015/0029163 | A1 | 1/2015 | Harris et al. |

* cited by examiner

200

400

Exemplary Computer
System 600

HARDWARE OVERLAY ASSIGNMENT

BACKGROUND OF THE INVENTION

Usage of mobile computing devices such as smartphones, tablets, computerized wristwatches, audio players, and netbooks have increased dramatically as the capability of these devices have expanded to coincide with advances in miniaturization. Foremost among these features is the ability to execute applications and operating systems of increasing complexities. Typically, mobile computing devices are implemented with advanced integrated circuits called "system on a chip" or alternately, "system on chip" (abbreviated as "SoC"), which integrate several functions and components of a traditional computing system on a single chip. These components often include one or more central processing units (CPUs), graphics processing units (GPUs), and display controllers, which cooperatively produce the graphical output and user interfaces of the applications and operating system executing in the mobile device and displayed in the display panel(s) of the mobile computing device.

However, due to inherent limitations arising from their miniaturized size, SoCs may suffer from performance issues, particularly when processing for multiple applications becomes intensive. To alleviate this problem, dedicated hardware overlays have been developed and are often incorporated in many SoC designs. Hardware overlays are dedicated buffers into which an application can render output without incurring the significant performance cost of checking for clipping and overlapping rendering by other executing applications. An application using a hardware overlay to store output is allocated a completely separate section of video memory accessible (at least temporarily) only to that application. Because the overlay is otherwise inaccessible, the program is able to bypass verifying whether a given piece of the memory is available to the program, nor does the application need to monitor for changes to the memory addressing.

Unfortunately, display controllers inside system on a chips have limited number of overlay windows. For example, many of the current generation of SoCs have three overlay windows per display controller. However, the number of distinct graphical layers to be composited (i.e., rendered) keeps increasing as content from various sources and available functionality expands with the development of increasingly complex applications. Each graphical layer typically corresponds to an application—in some cases, multiple layers can correspond to the same application—and represents the graphical output produced by the application and displayed on the screen or display panel of the mobile computing device.

When the number of graphical layers exceeds the number of overlay windows, an overlay overflow is triggered. When this happens, two or more layers must be pre-composited (i.e., aggregated as a single layer) by a pre-compositor before the aggregated layers are sent with the remaining non-aggregated layers to the display controller. Unfortunately this pre-composition process is a very expensive operation in terms of performance, power, and memory bandwidth consumption. In particular, this layer composition path often causes large amounts of memory traffic, which increases as the number of pixels as the number of layers increases. For example, video streaming applications are extremely popular among many users of mobile computing devices. Graphical output corresponding to a video streaming application may include a region that displays streaming video, along with a separate region that contains a graphical user interface for manipulating playback of the video. Each of these regions may be implemented as a separate graphical layer. Traditionally, the video output may be decoded and produced by a video decoder, with the GUI being produced by a GPU, and stored in a frame buffer or system memory. Other applications with similar dispositions include gaming applications, which may produce graphical output contained in one or more layers.

Other common layers include status bars, navigation bars, or virtual keyboards. One common display configuration is implemented such that a status bar corresponding to the mobile computing device occupies a relatively thin portion of the display at the top or bottom of the display. Information presented in the status bar may include such information as: remaining battery life; connectivity with a data network; bluetooth operation or non-operation; time, and/or graphical icons pertaining thereto. Another display configuration typically includes a virtual keyboard occupying a portion of the bottom of the display screen. Yet another common configuration includes a navigation bar that includes statically positioned graphical icons linked to critical or frequently used applications. As these features (and their corresponding layers) are updated infrequently, the layers may be pre-composited or composited separately from more active layers (such as video streaming or gaming applications) and also stored in frame buffers and/or external memory prior to being composited in the display controller with other pending layers as a single, coherent frame of graphical content.

However, due to the spatial arrangement (e.g., the status bar may be at the top, whereas the navigation bar or virtual keyboard at the bottom of the rendered display), since the size of frame buffers correspond to the size of a display frame, an entire frame buffer may be dedicated to storing the content from the static applications, even though a substantial, or even significant majority of the display—being apportioned to display actively updating application content—contains no actual graphical content. Naturally, significant inefficiency of both memory usage, and memory access bandwidth can result from conventional layering and overlay apportionment techniques.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An aspect of the present invention proposes a novel approach that can reduce the total number of the overlays to be composited during the display of graphical output in a mobile computing device. As a result, the total number of memory bandwidth and the usage of a graphics processing unit by a pre-compositor can be decreased significantly. According to one embodiment, this new approach is implemented with a display panel with embedded memory which supports a partial update, or refresh feature. Which such a feature, the layer compositor (typically either the display controller or GPU) is able to keep track of actively updating regions of a display panel by checking if each layer has new content to be displayed.

In an embodiment, the intersection of the new content inside the display frame is calculated, and the layers with no updated content are filtered from the list of layers to be composited. Subsequently, the compositor, sometimes referred to as the hardware composer, attempts to assign overlays. The static layers which are completely outside the union of the updated layers union can be ignored. Therefore, the final composited output coming out of the display controller does not contain the static layers. However, since the same previously composited content is already within the display panel's memory, the static content can still be displayed. From that point, a kernel display controller driver sends the new updated pixels with the updated area coordinates to be displayed.

According to another aspect of the invention, a system is provided that includes a mobile computing device comprising a central processing unit, a display controller, and optionally, a video decoder and graphics processing unit. In an embodiment, applications may be executed by the central processing unit. These applications may include, for example, video streaming applications which receive encoded data streams. A video decoder decodes the streams and transmits the content to be displayed to the display controller. Simultaneously, graphical output corresponding to other actively updating applications, or to other display regions of the video streaming application—such as a graphical user interface—is rendered, either in the GPU or the display controller itself. Each application is allocated a separate hardware overlay in the display controller, thus bypassing a frame buffer or external memory (e.g., RAM), and the resultant output is sent directly to a display panel and displayed at pre-determined positions in the display. Static content such as a status bar, navigation bar, or virtual keyboard which has not detected an update based on a comparison with a previous composited frame in the local memory of the display need not be updated.

The approaches described herein can provide better performance while reducing memory bandwidth and power consumption rates on many key applications, such as launcher, video streaming, and web browsing applications.

BRIEF DESCRIPTION OF THE DRAWINGS

The accompanying drawings are incorporated in and form a part of this specification. The drawings illustrate embodiments. Together with the description, the drawings serve to explain the principles of the embodiments.

DETAILED DESCRIPTION

Figure 1:
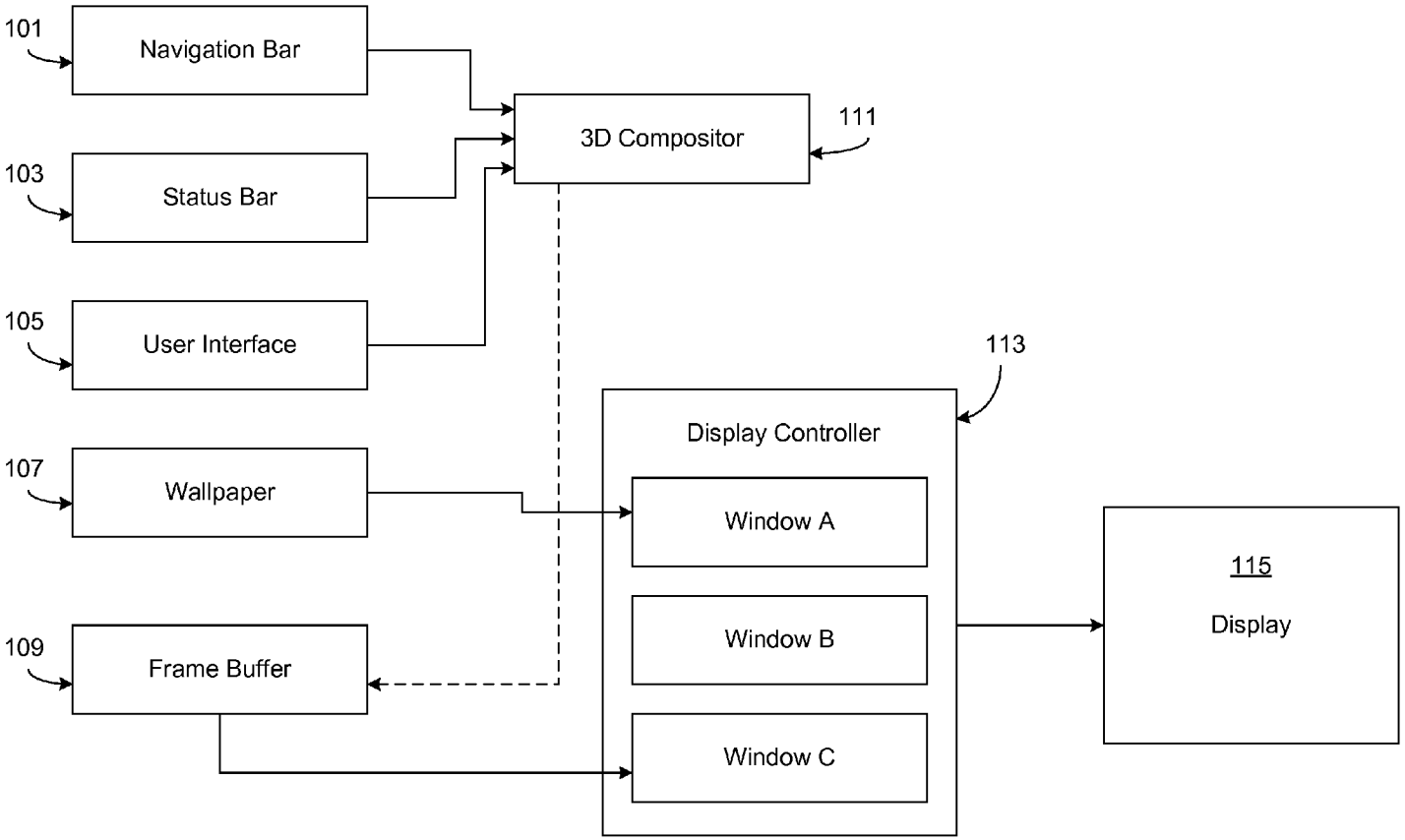
Figure 1 (Prior Art)
FIG. 1 depicts a data flow diagram for graphical output in a mobile computing device in accordance with conventional hardware overlay allocation techniques.

Reference will now be made in detail to the preferred embodiments of the claimed subject matter, a method and system for the use of a radiographic system, examples of which are illustrated in the accompanying drawings. While the claimed subject matter will be described in conjunction with the preferred embodiments, it will be understood that they are not intended to limit these embodiments. On the contrary, the claimed subject matter is intended to cover alternatives, modifications and equivalents, which may be included within the spirit and scope as defined by the appended claims.

Furthermore, in the following detailed descriptions of embodiments of the claimed subject matter, numerous specific details are set forth in order to provide a thorough understanding of the claimed subject matter. However, it will be recognized by one of ordinary skill in the art that the claimed subject matter may be practiced without these specific details. In other instances, well known methods, procedures, components, and circuits have not been described in detail as not to obscure unnecessarily aspects of the claimed subject matter.

Some portions of the detailed descriptions which follow are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer generated step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present claimed subject matter, discussions utilizing terms such as "storing," "creating," "protecting," "receiving," "encrypting," "decrypting," "destroying," or the like, refer to the action and processes of a computer system or integrated circuit, or similar electronic computing device, including an embedded system, that manipulates and transforms data represented as physical (electronic) quantities within the computer system's registers and memories into other data similarly represented as physical quantities within the computer system memories or registers or other such information storage, transmission or display devices.

Conventional Hardware Overlay Techniques

FIG. 1 illustrates a data flow diagram 100 for graphical output in a mobile computing device in accordance with conventional hardware overlay allocation techniques. As depicted in FIG. 1, a computing device may involve a graphics processing unit (e.g., 3D compositor 111), a frame buffer 109, a display controller 113, and a display 115. As depicted in FIG. 1, a computing device executing a plurality of applications or widgets may have corresponding graphical output produced by the applications and/or widgets, and which occupies a portion of screen space of the display 115. As shown in FIG. 1, these programs can include a navigation bar 101, a status bar 103, a user interface 105, and wallpaper 107.

As shown in FIG. 1, a display controller 113 may be implemented with a small plurality of hardware overlays (e.g., Window A, Window B, Window C). As shown in FIG. 1, graphical output from the wallpaper program 107 may be accelerated by bypassing the graphics processing unit 111 and the frame buffer 109 and storing the output directly in a hardware overlay (Window A). However, as the number of programs (four) exceeds the number of dedicated hardware overlays (three), usage of hardware overlays for every program would result in an overlay overflow. According to conventional output techniques to avoid an overlay overflow from occurring, multiple programs may be pre-composited into a single layer. As shown in FIG. 1, the navigation bar 101, the status bar, and the user interface 105 may be pre-compiled in graphics processing unit 111 prior to the actual composition of a display frame. Once the pre-compiled output has aggregated the various layers into a single contiguous layer, the resultant output is stored in a frame buffer 109 in an external memory. To produce the actual display, the pre-compiled output is loaded into a hardware overlay (e.g., Window C). The display controller 113 accumulates the data in each of the hardware overlays (Window A, Window C) to generate a display output which is sent to, and displayed in, display 115.

However, such pre-composition processes are often very expensive operations in terms of performance, power, and memory bandwidth consumption. In particular, because such a process is performed continuously as graphical output is produced, executing according to this layer composition path often causes large amounts of memory traffic, which only increases as the number of pixels as the number of layers increases.

Exemplary Display Configurations

Figure 2:
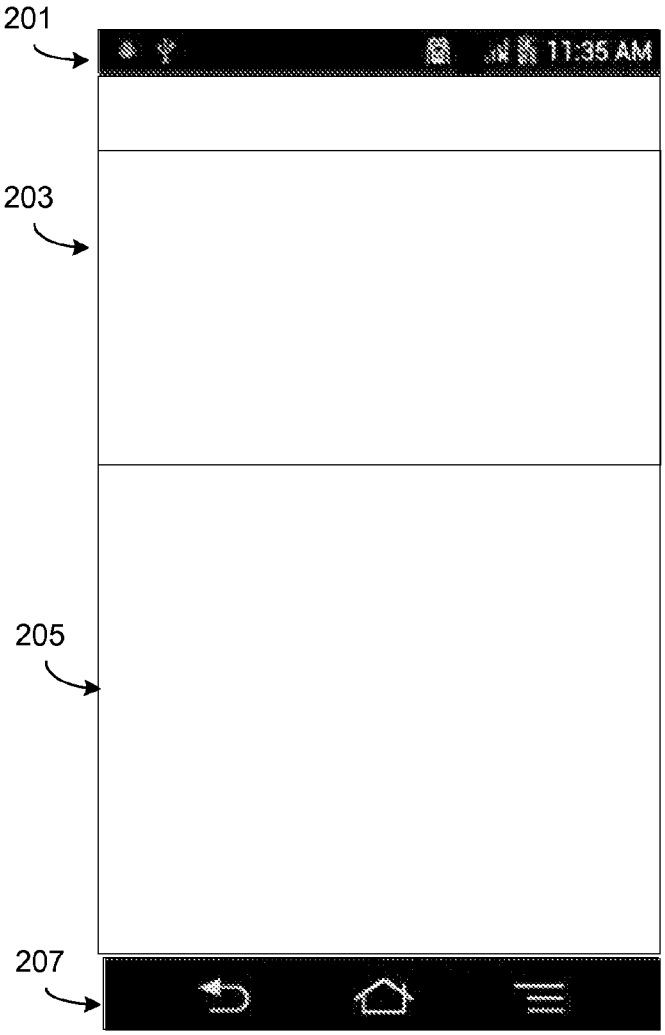
FIG. 2 depicts an exemplary display configuration of a plurality of graphical layers in accordance with various embodiments of the present invention.

FIG. 2 an exemplary display configuration 200 of a plurality of graphical layers in accordance with various embodiments of the present invention. In one or more embodiments, a display frame displayed in a screen or display panel of a computing device is composed of content displayed in a plurality of discrete graphical layers. According to various embodiments, the computing device may be implemented as mobile computing device, such as a mobile cellular telephone device or tablet computer. Alternate embodiments may include laptop or netbook computers, computerized wristwatches, digital audio and/or video players, and the like. The layers may correspond to one or more programs (e.g., applications or widgets) executed by a processor in the computing device. As depicted in FIG. 2, the display frame comprises four layers separate graphical layers, although embodiments of the present invention are well suited to circumstances with more or less graphical layers. The four layers depicted in FIG. 4 include both static layers (e.g., status bar 201, navigation bar 207) and active layers (e.g., content window 203, user interface 205).

According to one or more embodiments, the number of accelerated hardware overlays may be less than the number of graphical layers. Under these circumstances, traditional overlay allocation techniques may require pre-compositing of two or more layers, which can be costly in terms of resource and/or time. According to one or more embodiments of the claimed subject matter, however, one or both static layers (e.g., status bar 201, navigation bar 207) may bypass not only the graphics rendering portion of traditional graphical output processing, but may avoid using hardware overlays entirely. In these and other embodiments, display frames are stored in local memory of the display panel. This memory may be implemented as embedded memory, for example, and comprise one or more frame buffers. When the static layers require no updating (e.g., as determined by comparing the desired output with the content in the static layers of the previously stored display frame), no change is observed in the static layers in the display. Thus, in FIG. 2, the graphical content displayed in status bar 201 and navigation bar 207 may be maintained until an update is deemed to have occurred.

Content in the active layers (e.g., content window 203, user interface 205) may be continuously refreshed and updated in the display. However, since the number of layers does not exceed the number of hardware overlays, graphical output for the layers may be accelerated by sending graphical content directly to a hardware overlay, with a discrete hardware overlay being assigned to each layer. Accordingly, such a process bypasses the read and write operations to store graphical output in frame buffers in system memory, often external to the processors and/or display controllers on a system on a chip, and requiring memory access read and writes which can consume valuable computing resources and take undesired amounts of time to complete.

Hardware Overlay

Figure 3:
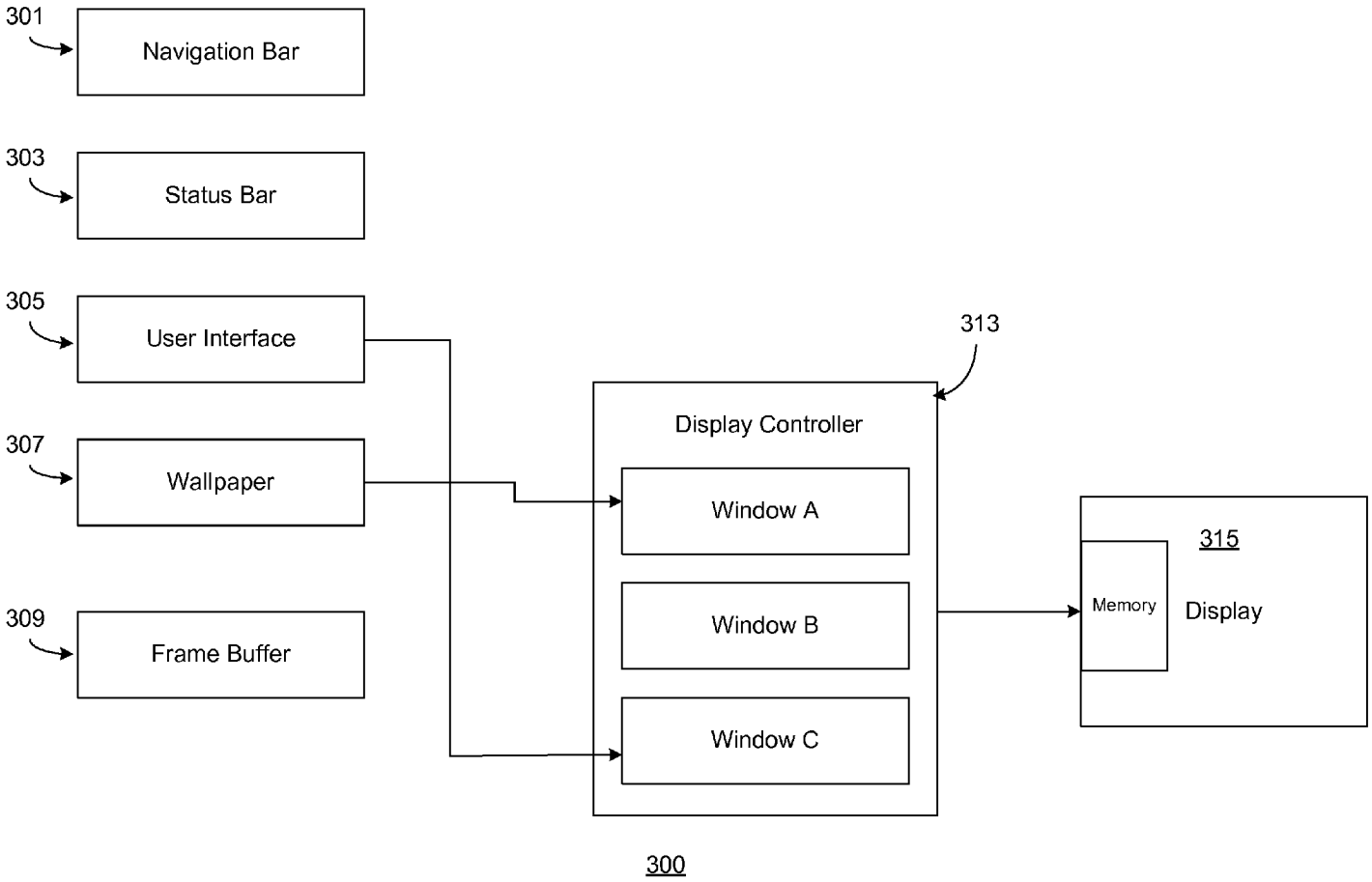
FIG. 3 depicts an exemplary data flow diagram for graphical output in a mobile computing device in accordance with various embodiments of the present invention.

FIG. 3 illustrates a data flow diagram 300 for graphical output in a mobile computing device in accordance with embodiments of the claimed subject matter. As shown in FIG. 3, a computing device is depicted in which a plurality of applications or widgets is executing. Each application or widget may produce corresponding graphical output that occupies a portion of screen space of the display 315 of the computing device. As shown in FIG. 3, these programs can include, but are not limited to, a navigation bar 301, a status bar 303, a user interface 305, and wallpaper 307.

As shown in FIG. 3, a display controller 313 in the mobile computing device may be implemented with a small plurality of hardware overlays (e.g., Window A, Window B, Window C). In one or more embodiments, graphical output from the wallpaper program 307 may be accelerated by storing the output directly in a hardware overlay (Window A). In contrast with conventional output techniques, the other actively updating layer (e.g., user interface layer 305) may also store its graphical output directly in a separate hardware overlay (e.g., Window C). Overlay overflows are automatically avoided since the static graphical layers (e.g., navigation bar 301, status bar 303) are pre-stored (as a portion of a display frame) in memory local to the display 315.

This is possible by initially determining the graphical output which layers are static (that is, unchanged) from the previous rendering cycle. Since no change in graphical output is detected in these cases, rendering in the SoC of the computing device (performed by either the display controller or a graphics processing unit) may be omitted entirely. In some instances, such as gaming applications, output produced by a graphics processing unit may be stored in a frame buffer 309 or other memory device. In alternate instances, the frame buffer 309 may be bypassed entirely, e.g., when relatively insignificant graphics processing is required, the display controller 313 may be used for graphics processing.

As shown in FIG. 3, pre-composing prior to the composition of a display frame by the display controller may be avoided under these and similar circumstances, resulting in savings in power consumed, processing, and memory access requests.

Figure 4:
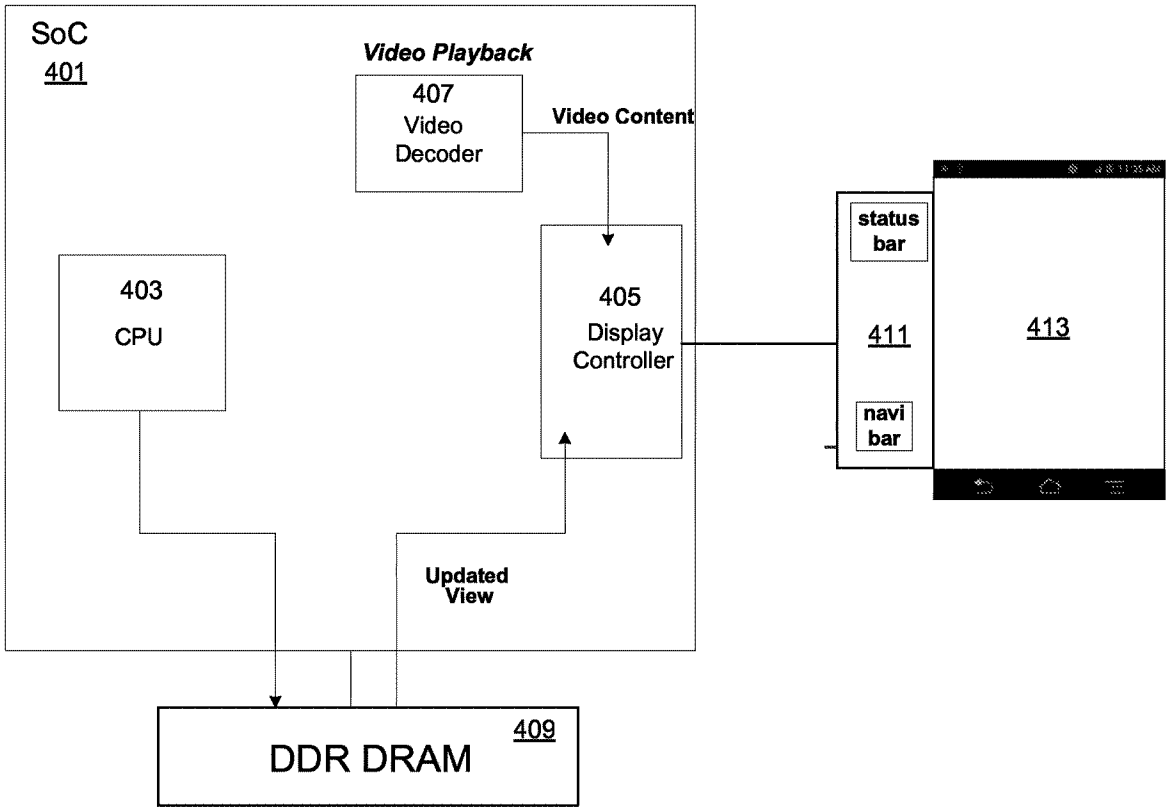
FIG. 4 depicts an exemplary data flow diagram for producing graphical output with a video decoder in accordance with various embodiments of the present invention.

FIG. 4 depicts an exemplary data flow diagram 400 for producing graphical output with a video decoder in accordance with various embodiments of the present invention. As shown in FIG. 4, a computing device is depicted that includes a system on a chip 401, external memory 409, and a display screen 413. In one or more embodiments, the system on a chip 401 may be implemented to include a central processing unit (CPU) 403 and display controller 405. Optionally, the system on a chip 401 may also include a graphics processing unit (not shown) and/or a video decoder 407.

According to one or more embodiments, the system on a chip 401 may execute a video streaming/playback application. In these embodiments, encoded data streams corresponding to video content may be continuously received as a stream of data bits from a data source (e.g., over a network connection). The data streams are decoded by the video decoder 407 and the decoded video content sent to the display controller 405 to be composited in a graphical layer. According to one or more embodiments, the video content may be stored in an accelerated hardware overlay, as described previously herein. In one or more embodiments, the video streaming application may also include a graphical user-interface. User manipulation of the graphical user-interface may be monitored, tracked, and graphically verified (e.g., by displaying corresponding cursor movement, graphical element actuation) by generating updated displays of the graphical user-interface in the CPU 403 (or a graphics processing unit). Once generated, updated displays are stored in external memory 409. In one or more embodiments, the external memory may be implemented as random access memory (RAM). In further embodiments, the memory may be implemented as advanced types of RAM, such as dynamic ram (DRAM), and/or using specific data protocols such as double data rate dynamic ram (DDR RAM).

According to various embodiments, the display controller retrieves the rendered data from the external memory 409 and composes a display frame from the rendered data and the video data. In one or more embodiments, the rendered data may also be stored temporarily in a hardware overlay. The resulting composited display frame is sent to the display screen 413, where it is combined with static content in a local memory 411 of the display screen before being displayed.

Figure 5:
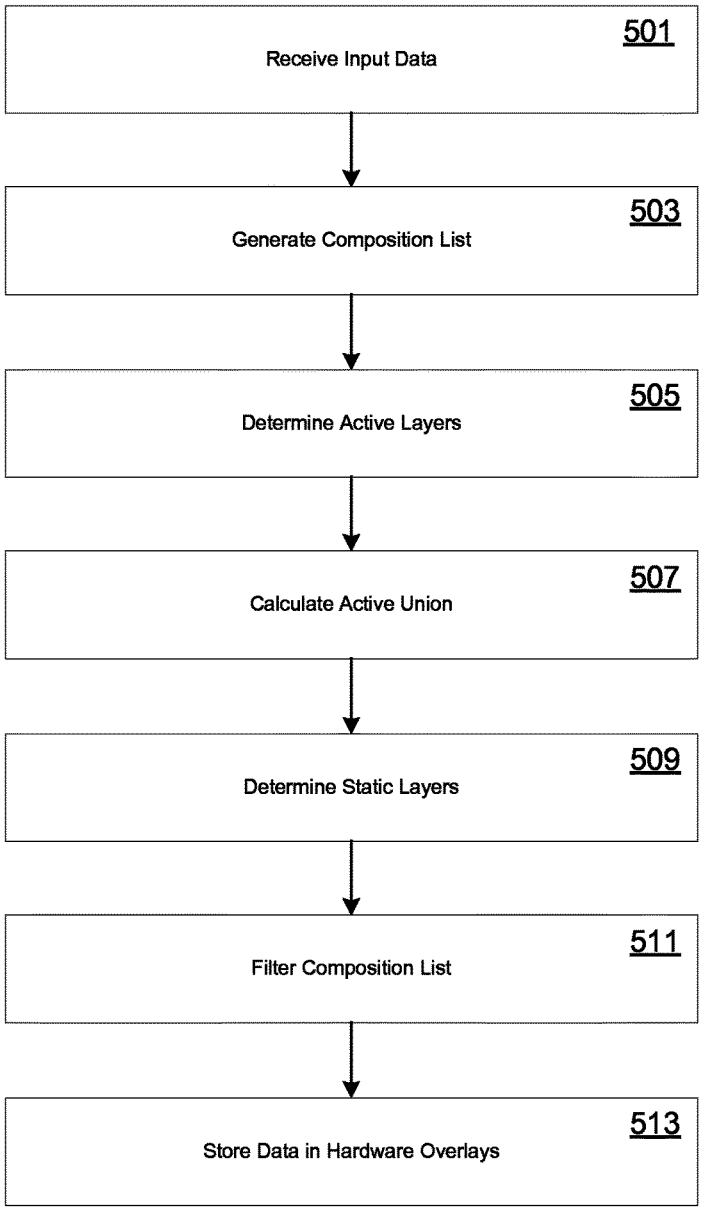
FIG. 5 depicts a flowchart of an exemplary process for allocating hardware overlays in a mobile computing device in accordance with various embodiments of the present invention.

FIG. 5 depicts a flowchart of an exemplary process 500 for allocating hardware overlays in a mobile computing device in accordance with various embodiments of the present invention. Steps 501-513 describe exemplary steps comprising the process 500 in accordance with the various embodiments herein described. According to various embodiments, steps 501-513 may be repeated continuously throughout an operation of a computing device. According to one aspect of the claimed invention, process 100 may be performed in, for example, a computing system comprising a system on a chip including a central processing unit (CPU), a display controller, and optionally, one or more graphics processing subsystems (GPUs, 3D rendering devices) and video decoders. As described previously herein, the computing system may be implemented as a mobile computing system, and capable of executing a plurality of programs (applications, widgets, etc.) capable of producing separate graphical outputs.

At step 501, application data is generated by one or more applications executing in the CPU. In one or more embodiments, the application data includes graphical output produced by the executing applications. A number of graphical layers is mapped to the graphical output, and a composition list is generated at 503 to determine the number of graphical layers to be composed. In some cases, a graphical layer may correspond to the entire graphical output of an application or widget. Alternately, multiple graphical layers may be mapped to distinct regions or content of graphical output produced by a single application.

At step 505, the graphical layers are parsed to determine active (updated) layers and static layers. Active layers may correspond to the applications which have produced updated or new graphical content since the last rendering cycle. Active layers may correspond but are not limited to, gaming applications, video streaming applications, and similar programs; or even user-input intensive applications (e.g., use-actuated movement in a wallpaper or other graphical user-interface). Static layers meanwhile may correspond to applications or widgets with infrequent changes in graphical output, such as status bars, navigation bars, virtual keyboard and the like.

At step 507, the union of active layers is calculated. In one or more embodiments, static layers may be positioned at the top and bottom borders of a display frame, with active content being displayed during a center portion of the display frame. According to such embodiments, the union may form a polygon—such as a rectangle. The coordinates of the resulting union area may be calculated in a coordinate plane corresponding to a display frame.

At step 509, any intersection between the union of active layers calculated at step 507 and the static layers determined in step 505 is determined, with the resulting static layers without an intersection with the union of active layers specifically designated. In other words, only the static layers which have produced no updated graphical content since the last rendering cycle are thus identified. The composition list generated at step 503 is filtered at step 511 to remove the set of static layers without intersection with the union of active layers. Finally, the output data corresponding to the graphical layers in the composition list is stored in hardware overlays at step 513.

According to further embodiments, a display controller can compose a display frame from the data stored in the hardware overlays at step 513. In such embodiments, the data corresponds to active updated content. Static content, filtered from the composition list at step 511 may not be recomposed, and hardware overlays are therefore not unnecessarily allocated for the storage of static graphical content. In such instances, static layers are still represented and displayed in a display screen or panel of the computing device by referencing local (e.g., embedded) memory of the display panel for previously displayed display frames. As the graphical content in the static layers have not changed since the last rendered cycle, the same content may be displayed in those layers, while replacing the displayed content in the active layers with updated content. By avoiding the composition of static graphical layers, hardware overlays may be reserved for graphical content from actively updating layers, thereby increasing overall performance and reducing unnecessary composition and costly pre-composition of redundant content.

Exemplary Computing System

Not every embodiment of the claimed subject matter may be implemented according to system on a chip architecture. As presented in FIG. 6, an alternate system for implementing embodiments includes a general purpose computing system environment, such as computing system 600. In its most basic configuration, computing system 600 typically includes at least one processing unit 601 and memory, and an address/data bus 609 (or other interface) for communicating information. Depending on the exact configuration and type of computing system environment, memory may be volatile (such as RAM 602), non-volatile (such as ROM 603, flash memory, etc.) or some combination of the two.

Computer system 600 may also comprise one or more graphics subsystems 605 for presenting information to the computer user, e.g., by displaying information on attached display devices 610.

Figure 6:
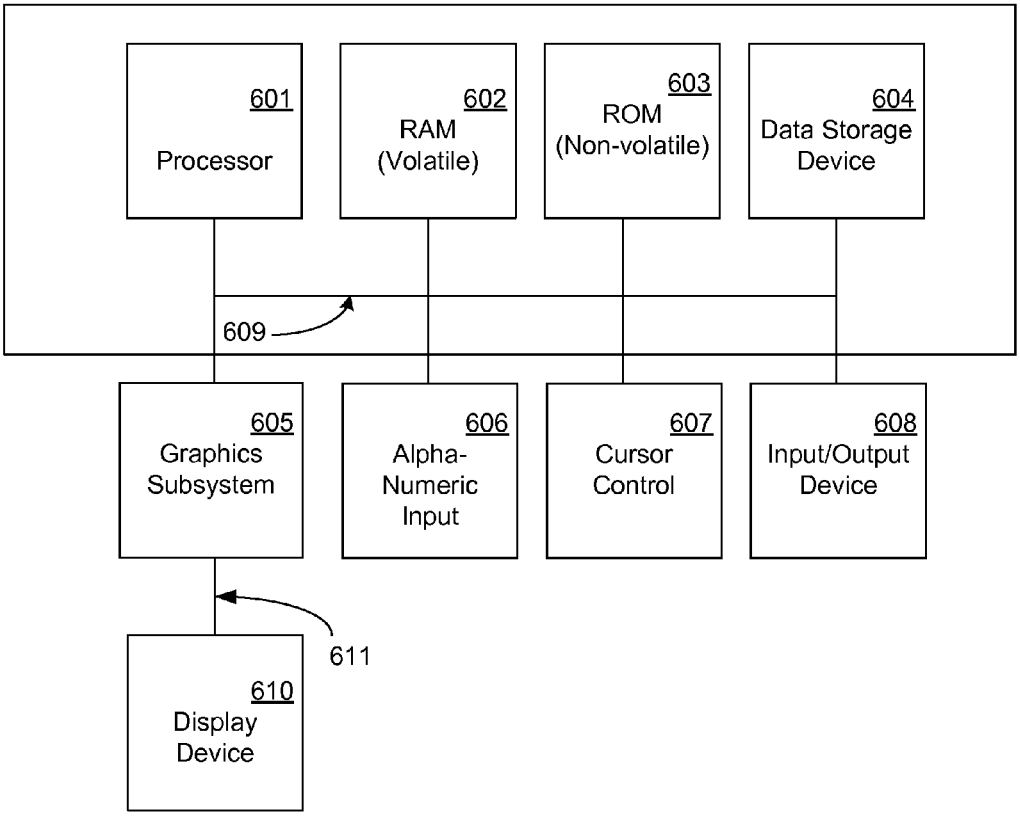
FIG. 6 depicts an exemplary computing system, upon which embodiments of the present invention may be implemented.

Additionally, computing system 600 may also have additional features/functionality. For example, computing system 600 may also include additional storage (removable and/or non-removable) including, but not limited to, magnetic or optical disks or tape. Such additional storage is illustrated in FIG. 6 by data storage device 604. Computer storage media includes volatile and nonvolatile, removable and non-removable media implemented in any method or technology for storage of information such as computer readable instructions, data structures, program modules or other data. RAM 602, ROM 603, and data storage device 604 are all examples of computer storage media.

Computer system 600 also comprises an optional alphanumeric input device 606, an optional cursor control or directing device 607, and one or more signal communication interfaces (input/output devices, e.g., a network interface card) 608. Optional alphanumeric input device 606 can communicate information and command selections to central processor 601. Optional cursor control or directing device 607 is coupled to bus 609 for communicating user input information and command selections to central processor 601. Signal communication interface (input/output device) 608, which is also coupled to bus 609, can be a serial port. Communication interface 609 may also include wireless communication mechanisms. Using communication interface 609, computer system 600 can be communicatively coupled to other computer systems over a communication network such as the Internet or an intranet (e.g., a local area network), or can receive data (e.g., a digital television signal).

According to embodiments of the present invention, novel solutions and methods are provided for improved allocation of dedicated hardware overlays. By referencing pre-rendered graphical output for static data, the dedicated hardware overlays may be reserved for the display of actively updating graphical content without costly pre-composition that commonly accompanies traditional overlay allocation techniques. This new approach allows layer compositors to compose additional layers using hardware display controller overlays even though the total layer count may be greater than the overlay counts of given hardware when accounting for static layers.

According to the embodiments described herein, various advantages are provided by such techniques. From a memory bandwidth perspective, potential memory bandwidth savings are available simply due to sending less data through the display controller. Even larger savings results from potentially bypassing the pre-compositor completely. The number of layers may be potentially reduced by the number of static layers if the layers do not intersect with the updated area. This results in a much larger gain because the application processor can perform and/or process other tasks in lieu of re-rendering or re-compositing the static layers, and/or may be able to decrease its operational clock speed to save power. From a performance and power perspective, the number of layers to be composited can be reduced significantly. Also, the expensive pre-compositor, usually implemented using the 3D engine, may be completely avoided. Therefore, this new technique can provide higher framerates and less power consumption on high-resolution displays.

The battery life in mobile devices is also an important consideration in the operation of any mobile computing device. By implementing the techniques described herein, the battery life for all mobile devices with a memory in the display panel can be significantly increased. These techniques can also improve user-interface performance on the devices with high resolutions when the memory bandwidth becomes a big hurdle. This not only allows for the circumvention of the general purpose overlay limitations when the UI elements are partially animating, but also allows the performance of less overall work.

In the foregoing specification, embodiments have been described with reference to numerous specific details that may vary from implementation to implementation. Thus, the sole and exclusive indicator of what is the invention, and is intended by the applicant to be the invention, is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

What is claimed is:

1. A method for generating a plurality of graphical overlays for a display frame, the method comprising:

receiving input data corresponding to a plurality of graphical layers;

generating a composition list comprising the plurality of graphical layers;

determining a plurality of active layers and a plurality of static layers from the plurality of graphical layers;

calculating a union area comprising the plurality of active layers;

determining a set of static layers, the set of static layers comprising static layers from the plurality of static layers without an intersection with the union area;

filtering the set of static layers from the composition list; and storing data corresponding to the layers comprised in the composition list in a plurality of hardware overlays comprised in a display controller of a computing device, wherein the set of static layers are stored in a first hardware overlay of the plurality of hardware overlays, further wherein storing the data corresponding to the layers comprised in the composition list comprises storing the data corresponding to the layers comprised in the composition list in a separate hardware overlay of the plurality of hardware overlays from the first hardware overlay.

2. The method according to claim 1, further comprising storing data corresponding to the set of static layers in a display memory, the display memory being communicatively coupled to a display panel of the computing device.

3. The method according to claim 2, further comprising:

retrieving data in the plurality of hardware overlays;

composing an active display frame comprising the data corresponding to the plurality of active layers in the plurality of hardware overlays;

sending the active display frame to the display memory; and displaying the active display frame with a static display frame corresponding to the set of static layers in the display panel.

4. The method according to claim 3, wherein the composing the plurality of graphical layers is performed in a display controller comprised in the computing device.

5. The method according to claim 3, wherein the composing the plurality of graphical layers is performed in a 3D graphics rendering engine.

6. The method according to claim 1, wherein the plurality of hardware overlays comprises a fixed plurality of hardware accelerated overlays.

7. The method according to claim 1, wherein the computing device comprises a mobile computing device.

8. The method according to claim 7, wherein the mobile computing device comprises a mobile computing device from the group of:

a mobile cellular telephone device;

a tablet computer;

a computerized wristwatch;

a mobile audio player; and a laptop computer.

9. The method according to claim 1, wherein the input data comprises application data corresponding to an application executing in the computing device.

10. The method according to claim 1, wherein the set of static layers is displayed in the display panel while bypassing composition in the display controller.

11. A computing system comprising:

a memory device;

a system on a chip (SoC), communicatively coupled to the memory device and comprising:

a processor configured to execute a plurality of applications, and operable to generate a plurality of active graphical layers corresponding to the plurality of applications, and to store the plurality of active graphical layers in the memory device;

a plurality of hardware overlays configured to receive the plurality of active graphical layers from the memory device;

a display controller comprising the plurality of hardware overlays and configured to compose a plurality of display frames based on content in the plurality of hardware overlays; and a display panel comprising a local memory configured to store a plurality of static graphical layers filtered from a composite list comprising both the plurality of static graphical layers and the plurality of active graphical layers, wherein the plurality of active graphical layers and the plurality of static graphical layers are displayed in the display panel, wherein the set of static layers are stored in a first hardware overlay of the plurality of hardware overlays and the layers corresponding to the filter composition list are stored in a second hardware overlay of the plurality of hardware overlays.

12. The computing system according to claim 11, wherein the SoC further comprises a video decoder configured to render video output for one or more applications of the plurality of applications, and to store the video output in the plurality of hardware overlays.

13. The system according to claim 11, wherein the memory device comprises a dynamic random access memory (DRAM) device.

14. The system according to claim 13, wherein the memory device comprises a double data rate (DDR) DRAM device.

15. The system according to claim 11, wherein the SoC further comprises a graphics processing unit (GPU) configured to generate graphical output for the plurality of applications, wherein at least a portion of the plurality of display frames are composed in the GPU.

16. The system according to claim 11, wherein the plurality of active graphical layers and the plurality of static graphical layers correspond to graphical displays at fixed locations in the display panel.

17. The system according to claim 16, wherein the plurality of static graphical layers are comprised from the group comprising:

a navigation bar;

a status bar; and a virtual keyboard.

18. The system according to claim 16, wherein the plurality of active graphical layers are comprised from the group comprising:

a user interface;

a mobile wallpaper.

19. The system according to claim 11, wherein the computing system comprises a mobile computing system from the group consisting of:

a mobile cellular telephone device;

a tablet computer;

a computerized wristwatch;

a mobile audio player; and a laptop computer.

20. A non-transitory computer readable storage medium comprising program instructions embodied therein, the program instructions comprising:

instructions to receive input data corresponding to a plurality of graphical layers;

instructions to generate a composition list comprising the plurality of graphical layers instructions to determine a plurality of active layers and a plurality of static layers from the plurality of graphical layers;

instructions to calculate a union area comprising the plurality of active layers;

instructions to determine a set of static layers, the set of static layers comprising static layers from the plurality of static layers without an intersection with the union area;

instructions to filter the set of static layers from the composition list; and instructions to store data corresponding to the layers comprised in the composition list in a plurality of hardware overlays, the plurality of hardware overlays being comprised in a display controller of a computing device, wherein the set of static layers are stored in a first hardware overlay of the plurality of hardware overlays, further wherein the instructions to store the data corresponding to the layers comprised in the composition list comprises instructions to store the data corresponding to the layers comprised in the composition list in a separate hardware overlay of the plurality of hardware overlays from the first hardware overlay.

* * * * *